US007828115B2

(12) United States Patent
Sayles

(10) Patent No.: US 7,828,115 B2
(45) Date of Patent: Nov. 9, 2010

(54) WEIGHT-RELEASING LADDER LOCKSTEP

(75) Inventor: John Sayles, West Chester, PA (US)

(73) Assignee: Ballymore Company, Inc., West Chester, PA (US)

( * ) Notice: Subject to any disclaimer, the term of this patent is extended or adjusted under 35 U.S.C. 154(b) by 967 days.

(21) Appl. No.: 11/375,147

(22) Filed: Mar. 14, 2006

(65) Prior Publication Data

US 2006/0225954 A1 Oct. 12, 2006

Related U.S. Application Data

(60) Provisional application No. 60/661,955, filed on Mar. 15, 2005.

(51) Int. Cl.
*E06C 5/00* (2006.01)

(52) U.S. Cl. ..... 182/15; 182/17

(58) Field of Classification Search ..... 182/15, 182/17

See application file for complete search history.

(56) References Cited

U.S. PATENT DOCUMENTS

| | | | | |
|---|---|---|---|---|
| 2,798,652 | A | | 7/1957 | Easton |
| 2,955,645 | A | | 10/1960 | Cramer |
| 3,155,190 | A | | 11/1964 | Borgman |
| 3,291,254 | A | | 12/1966 | Mihalik |
| 3,559,761 | A | | 2/1971 | Wehner |
| 4,044,857 | A | | 8/1977 | Guerette |
| 4,063,616 | A | | 12/1977 | Gutierrez |
| 4,166,516 | A | | 9/1979 | Thurmond, Jr. |
| 4,417,738 | A | * | 11/1983 | Kendall ..... 280/43.17 |
| 4,588,203 | A | * | 5/1986 | Anderson ..... 280/47.331 |
| 4,923,050 | A | * | 5/1990 | Vitols ..... 182/127 |
| 5,791,434 | A | | 8/1998 | Swiderski |
| 5,806,863 | A | * | 9/1998 | Heger et al. ..... 280/33.998 |
| 5,941,341 | A | | 8/1999 | Gillis et al. |
| 6,026,931 | A | | 2/2000 | Swiderski |
| 6,039,147 | A | | 3/2000 | Gillis et al. |
| 6,179,087 | B1 | | 1/2001 | Moffat |
| 6,305,496 | B1 | | 10/2001 | Bieszczad |
| 6,505,359 | B2 | * | 1/2003 | Heimbrock et al. ..... 5/86.1 |
| 6,507,975 | B2 | * | 1/2003 | Maupin et al. ..... 16/34 |
| 6,523,640 | B1 | | 2/2003 | Young et al. |
| 2001/0013444 | A1 | | 8/2001 | Gillis et al. |
| 2003/0209385 | A1 | | 11/2003 | Kuehl et al. |
| 2005/0029048 | A1 | | 2/2005 | Frame et al. |

* cited by examiner

*Primary Examiner*—Alvin C Chin-Shue
(74) *Attorney, Agent, or Firm*—Rudoler & DeRosa LLC

(57) ABSTRACT

A novel lockstep mechanism for a rolling ladder is described. The weight-releasing ladder lockstep allows a ladder to be relocated on wheels but when a person climbs the ladder, the front wheels are automatically retracted and the ladder rests firmly with its front feet on the floor. When in the climbing (stationary) position the front wheels of the lockstep are retracted and the ladder rests on the lockstep's feet. When in the rolling position, the ladder is tilted slightly back on its rear wheels and the wheels of the lockstep are pushed down to allow the ladder to roll. When in the rolling position, the lockstep wheels are held in place via a latch which is isolated from rolling vibrations through pivoting shock links and springs.

16 Claims, 7 Drawing Sheets

WEIGHT-RELEASING LADDER LOCKSTEP

CROSS REFERENCE TO RELATED APPLICATION

The present application claims the benefit of U.S. Provisional Application No. 60/661,955 filed on Mar. 15, 2005, which is incorporated herein by reference.

BACKGROUND OF THE INVENTION

Lockstep ladders were first introduced over fifty years ago. A lockstep is used to raise a rolling ladder, also commonly know as a rolling staircase, into its rolling position and when stepped on, drops the ladder's feet to the ground thereby locking it in the climbing position.

Since their inception all locksteps have functioned basically the same way. A lever is used to raise the ladder into the rolling position and it is held in place by a hook which is generally kept in place by a tension spring. The original design of the lockstep uses the bottom step as a lever. The step pivots on its rear edge and the front of the step is raised when the ladder is in the rolling position. When the user steps on the first step of the ladder the front of the step is rotated down by the weight of user, releasing the lockstep and dropping the feet to the floor putting the ladder in the climbing position.

This design worked well for many years but had significant functional and safety problems. Functionally, the ladder was difficult to put in the rolling position for taller, heavier ladders. The step needed to be lifted up with the top of the foot to put the ladder in the rolling position, the heavier the ladder the more difficult this was to do. The safety problem came into play primarily when the ladder was left on a retail store floor unattended and in the rolling position. In this position the front of the step was up. Shoppers, often children, would sit on the lowest step and generally grab the step as they were sitting. The ladder was released by their body weight as they were sitting and would severely pinch and in some cases sever shoppers' fingers.

In the late 1990's ladder manufactures all became painfully aware of this problem as accident victims sued the manufacturers. Since that time most manufactures changed to a new design which involves two separate levers, a pedal to lift the ladder into the rolling position and a trip bar to release the ladder, dropping it to the floor. In this prior art design the step does not move. The trip bar is positioned in front of the step so that when the user steps on the bottom step his foot pushes the trip bar down releasing the lockstep and the ladder feet drop to the ground for climbing. This design eliminates the safety problem and works well, however this prior art lockstep has two areas where improvement would be desirable. First, it has two levers: the pedal and the trip bar. Users get confused and try to lift the ladder by pushing on the trip bar breaking the lockstep. Second, the trip bar can be easily stepped over or bent out of position from stepping on it as described above. This action allows the ladder to be climbed in the rolling position a violation of OSHA and ANSI safety regulations. This also creates a durability problem since the lockstep is designed to support the weight of the ladder in the rolling position not a ladder and person.

BRIEF DESCRIPTION OF THE INVENTION

A novel lockstep mechanism for a rolling ladder is described. The weight-releasing ladder lockstep allows a ladder to be relocated on wheels but when a person climbs the ladder, the front wheels are automatically retracted and the ladder rests firmly with its front feet on the floor. When in the climbing (stationary) position the front wheels of the lockstep are retracted and the ladder rests on the lockstep's feet. When in the rolling position, the ladder is tilted slightly back on its rear wheels and the wheels of the lockstep are pushed down to allow the ladder to roll. When in the rolling position, the lockstep wheels are held in place via a latch which is isolated from rolling vibrations through pivoting shock links and springs.

DETAILED DESCRIPTION OF THE INVENTION

Figure 1:
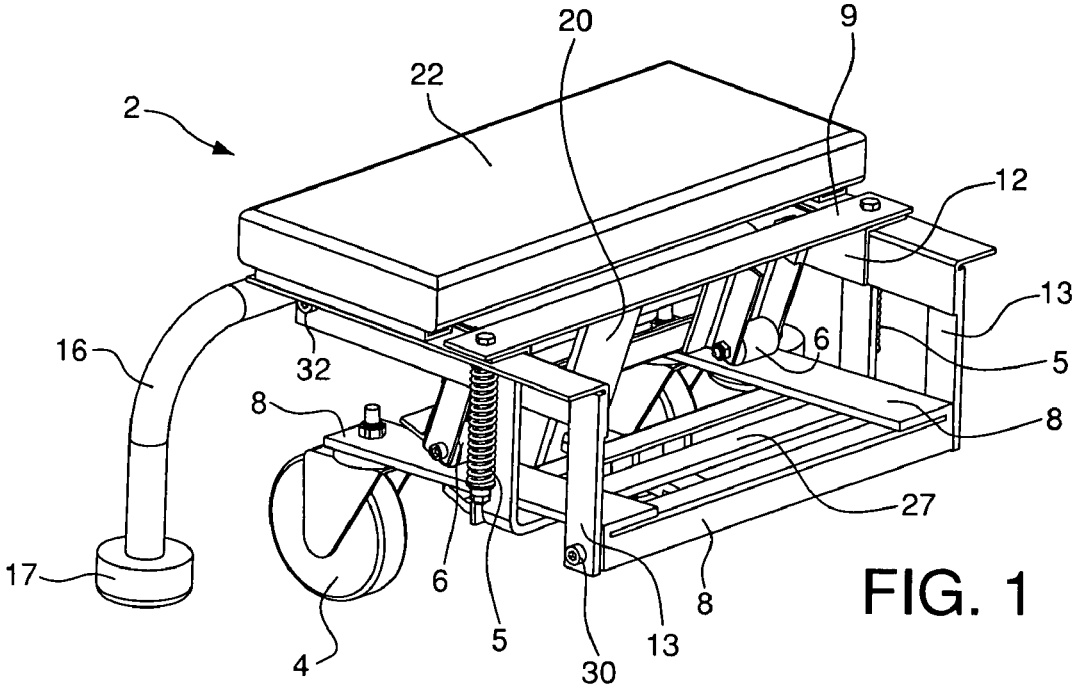
FIG. 1 is a perspective view of the lockstep in the rolling position.
Figure 2:
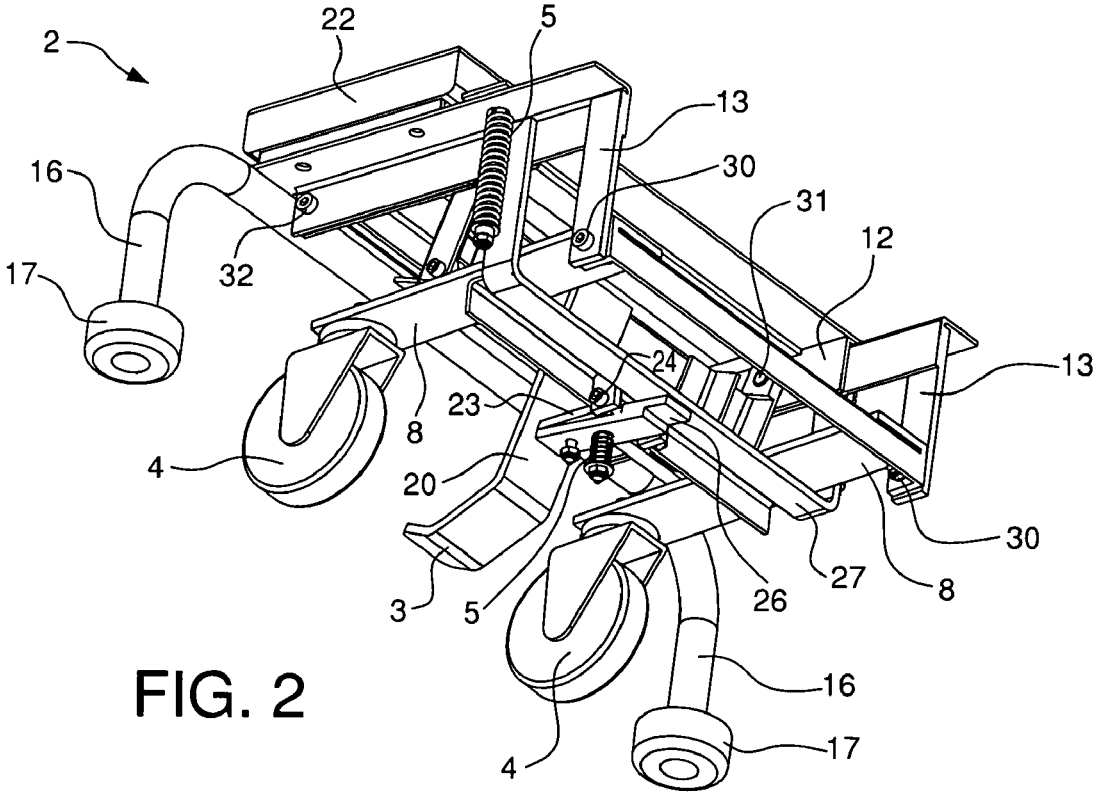
FIG. 2 is a perspective view of the lockstep from underneath in the rolling position.
Figure 3:
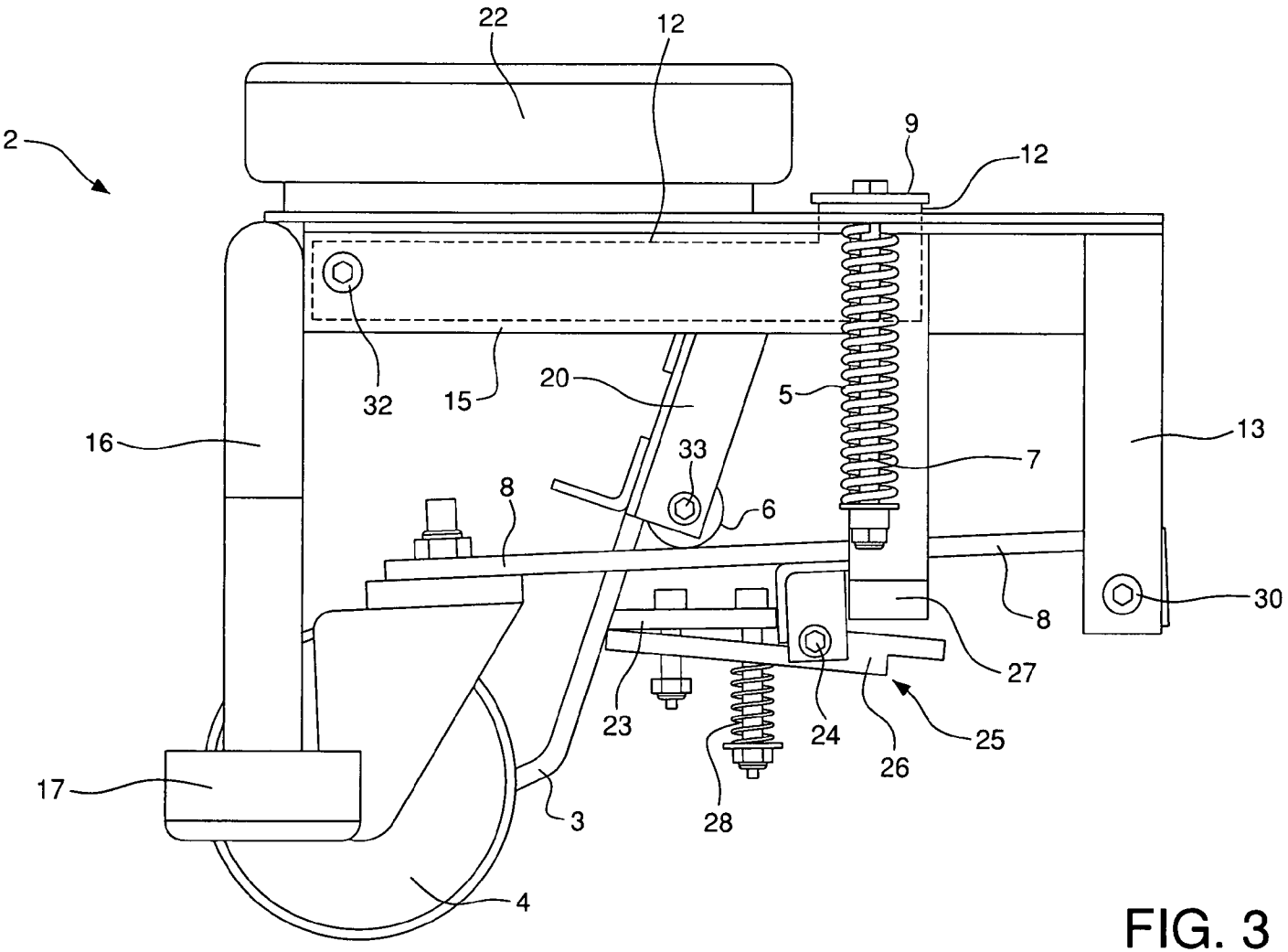
FIG. 3 is a side view of the lockstep in the rolling position.

The improved lockstep 2 is shown in FIGS. 1, 2 and 3. In this preferred embodiment, the ladder 1 (shown in FIG. 4) is put in the latched or rolling position using a single pedal 3. While in the stationary position (wheels retracted) the base step 22 is supported through legs 16 and feet 17. Preferably, there is no trip bar in this improved design. The ladder stairs 18 are moved into rolling position using a foot pedal 3 and rollers 6 to provide leverage, thereby lifting even the largest ladders easily. In the rolling position, compression springs 5 in combination with shock links 12 are used to support the weight of the ladder 1 and to function as shock absorbers allowing the ladder 1 to be rolled over rough surfaces without activating the release of the lockstep 2. As a user steps on the base step 22 his weight tilts the ladder stairs 18 forward and towards the ground. The compression springs 5 are calibrated using spacers in such a way that as soon as the user applies a predetermined amount weight (in one preferred embodiment seventy pounds) to the base step 22, the shock link 12 pivots up causing the release bar 27 to mechanically release a latch 25 allowing the lockstep frame 20 to swing free dropping the feet 17 to the floor and making the ladder 1 ready for climbing. This prevents anyone from being on the ladder 1 without the ladder dropping into a safe climbing position.

This invention is a major improvement over existing weight actuated locksteps which all tend to fall into the stationary position when rolled across floors due to vibration. In prior art designs, it was difficult to adjust latch or spring tension so that it would be tense enough not to release from rolling vibrations yet sufficiently relaxed so that the weight of a smaller person or child (about seventy pounds) would cause it to release. If the tension was set too high, lighter users could step on the ladder without it falling into non-moveable position, thus creating a safety hazard. If the tension was set too low, the ladder feet would fall to the ground while the ladder was being moved thus creating a major nuisance and making the ladder impractical for many environments. The present invention overcomes this limitation.

Figure 5:
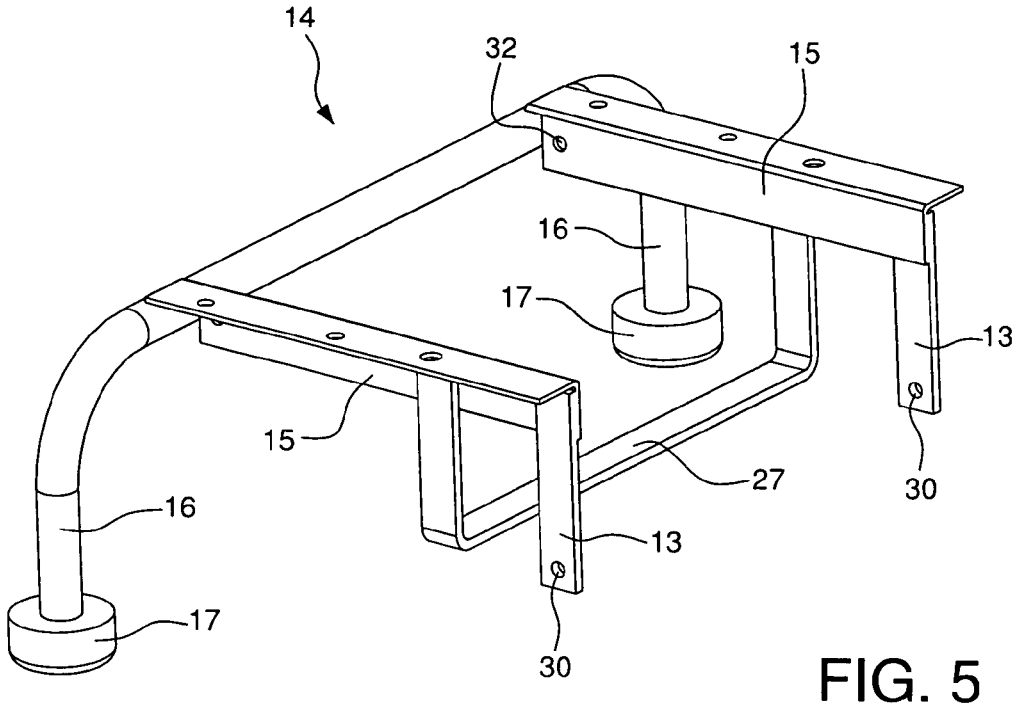
FIG. 5 is a perspective view of the lockstep base.
Figure 6:
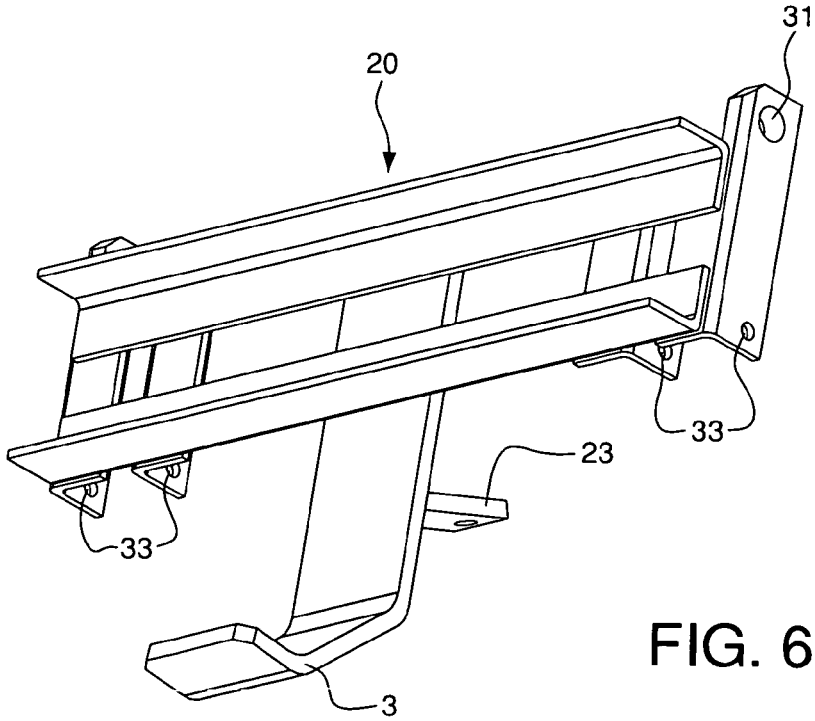
FIG. 6 is a perspective view of the lockstep frame.
Figure 7:
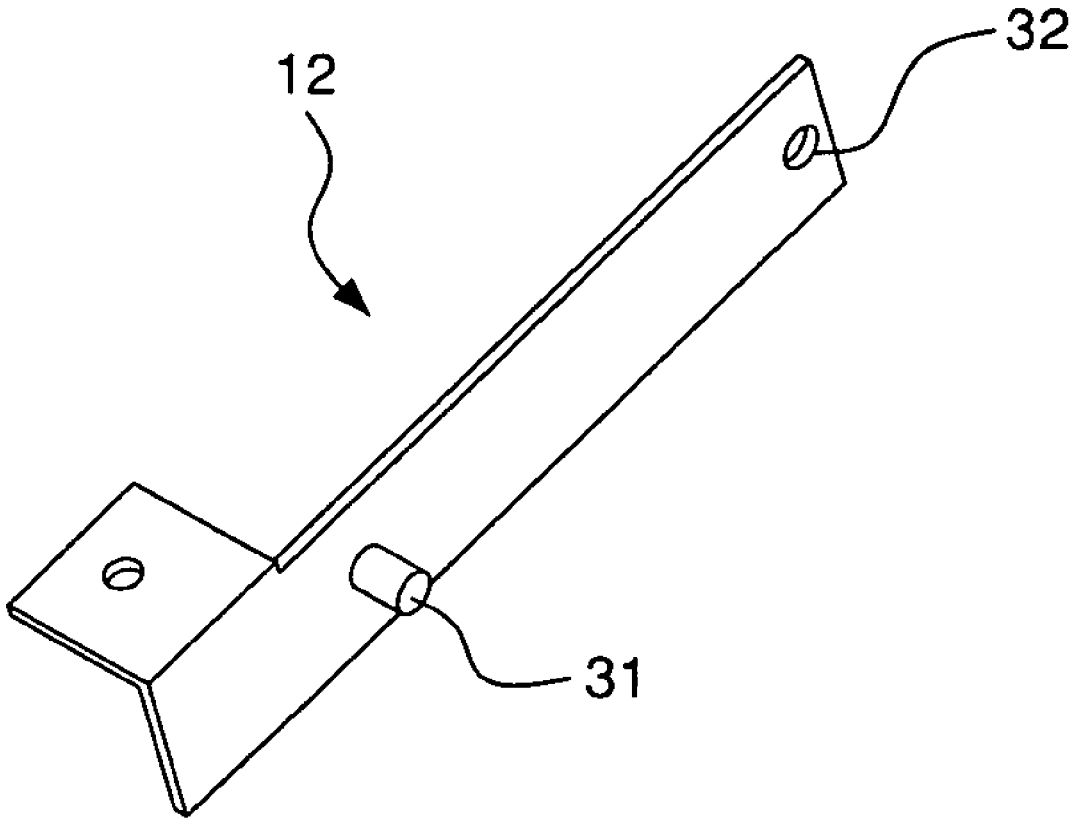
FIG. 7 is a perspective view of a shock link.

With reference to FIGS. 1, 2 and 3, a lockstep base 14 is made up of legs 16, feet 17 and lockstep base frame 15, all rigidly attached to the bottom ladder step 22 (also referred to herein as a base step). FIG. 5 shows a perspective view of the lockstep base 14 (base step 22 not shown). A caster wheel frame 8 supports caster wheels 4 and is pivotally attached to the lockstep base frame 15 at the caster pivots 30 on the base frame extension arms 13, said base frame extension arms 13 forming a portion of the lockstep base frame 15. A lockstep frame 20 with a pedal 3 (preferably shaped to easily allow a user to apply pressure through his foot) moves across the caster frame 8 on rollers 6 and is pivotally attached to two shock links 12 (one on each side of the lockstep base 14) at the lockstep frame pivots 31. FIG. 6 shows lockstep frame alone. Two rollers 6 (not shown in FIG. 6) are mounted through the roller pivots 33 viewable in FIG. 6. Preferably, the two shock links 12 are attached by a cross bar 9 to stabilize the shock links 12, as shown in FIG. 1. FIG. 7 shows one of the two shock links alone.

The lockstep frame 20 further has a latch mount 23 to which a latch arm 26 is attached for engaging into a latch catch 24 underneath the caster frame 8. The latch mount 23, latch arm 26, latch catch 24 and latch spring 28, together form a latch 25.

The shock links 12 are pivotally connected to the lockstep base frame 15 at the shock link pivots 32. The shock links 12 are held in place against the lockstep base frame 15 by springs 5 that press the two together via a bolt 7 that passes through the lockstep base frame 15 and the shock links 12. In this manner as the shock links 12 pivot up, the bolt 7 pulls the bottom of the spring 5 up and compresses it against the lockstep base frame 15. The result is that as the shock links 12 pivot upwards, the springs 5 apply a downward force to pull the shock links 12 back towards the lockstep base frame 15.

Figure 8A:
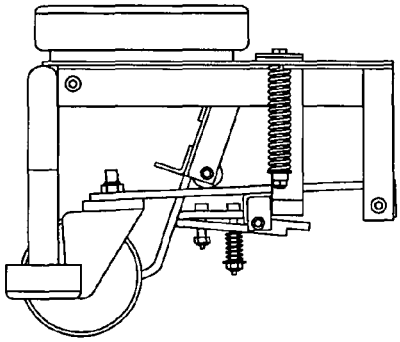
FIG. 8 is a series of side views of the lockstep showing the stages of movement of the lockstep invention from rolling position to stationary position.
Figure 8B:
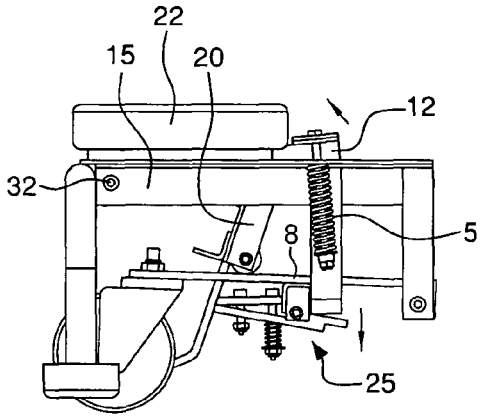
Figure 8C:
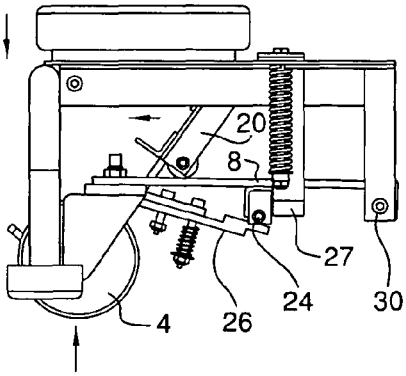
Figure 8D:
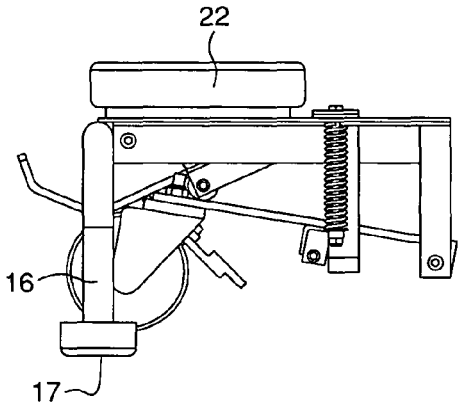
Figure 9A:
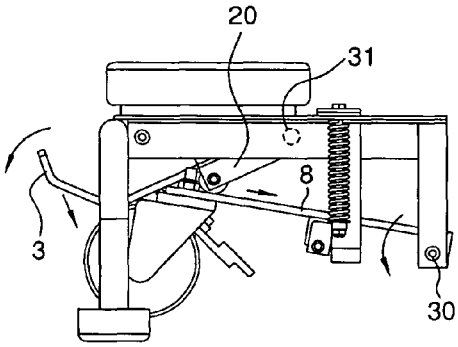
FIG. 9 is a series of side views of the lockstep showing the stages of movement of the lockstep invention from stationary position to rolling position.
Figure 9B:
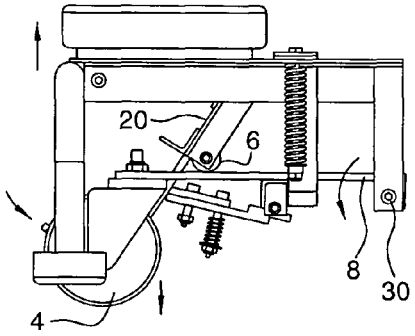
Figure 9C:
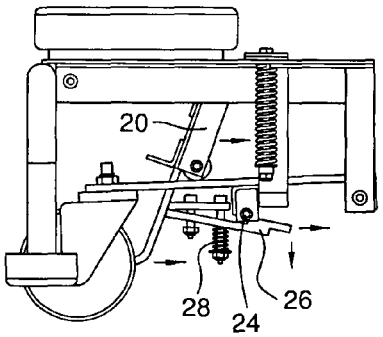
Figure 9D:
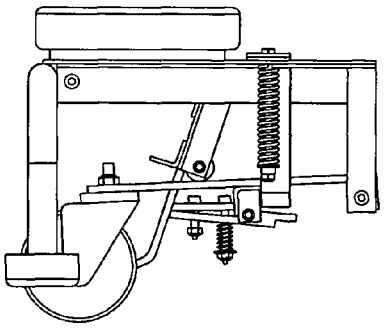

In order to show the working of the invention, FIGS. 8*a* through 8*d* show the lockstep moving from the rolling (wheels down) position to the stationary (feet down) position, and FIGS. 9*a* through 9*d* show the lockstep moving back to the rolling position. To more clearly describe the invention, certain stages have been repeated so that FIGS. 8*a* and 9*d* (and FIG. 3) are the same and FIGS. 8*d* and 9*a* are the same.

In the wheels-down rolling position (FIGS. 1, 2, 3, 4, 8*a* and 9*d*), the latch 25 is engaged and holds the caster wheel frame 8 to keep the wheels 4 in the down position. The weight of the ladder 1 is supported by the caster wheels 4 on the caster frame 8 which is held down by the lockstep frame 20 through the rollers 6. In this position the ladder stairs 18 and ladder frame 40 are rotated slightly back on the rear wheels 41 of the ladder 1. While the ladder 1 is being relocated on its wheels 4, 41, the ladder 1 might encounter bumps in the floor surface. The bumps cause the caster wheels to "push up" on the ladder. The "pushing up" is absorbed to a great extent by the shock link springs 5, thus preventing the latch 25 from decoupling from the caster wheel frame 8 and lowering the lockstep base 14 onto its feet 17. In all known prior art weight releasing locksteps, the combination of heavy stairs and rough surfaces would often cause the latching mechanism to release thus raising the front wheels and preventing further rolling of the ladder. By isolating the caster wheel frame 8 from the lockstep base 14 through shock links 12 and springs 5, the ladder 1 can be rolled across bumpy surfaces without the vibrations causing the latch 25 to release.

When a user steps on the ladder 1 (usually on the base step 22), his weight causes the shock link springs 5 to compress and shock links 12 to pivot up at the shock link pivots 32 (FIG. 8*b*). As the shock links 12 pivot up, they pull up the lockstep frame 20 with them which in turn pulls the caster frame 8 upwards. During this upward movement of the lockstep frame 20 and the caster frame 8, the latch arm 26 is forced against the latch release bar 27 causing the latch arm 27 to disengage from the latch catch 24, releasing it from the caster frame 8 (FIG. 8*c*). At this point, the lockstep frame 20 is free to move on its rollers 6 across the caster frame 8 and the lockstep frame 20 pivots up allowing the caster frame 8 to freely pivot up via the caster pivots 30. With the casters 4 unable to support the weight of the ladder 1, the ladder rests firmly on the feet 17 and legs 16 of the lockstep base 14 (FIG. 8*d*). It should be noted that the same disengagement would occur if a user skipped the base step 22 and tried to stand on any of the lower stairs 18 of the ladder 1.

As shown in FIG. 9, to put the ladder 1 back into the rolling position a user presses, preferably with his foot, on the lockstep frame pedal 3. This causes the lockstep frame 20 to pivot, via the lockstep frame pivots 31, causing a downward force on the caster frame 8 through the rollers 6 as the lockstep frame 20 moves down and towards the back (the lockstep base feet 17 being the front) rolling across the caster frame 8 (FIG. 9*a*). This downward force causes the caster frame 8 to pivot down, via the caster pivots 30, forcing the caster wheels 4 onto the ground and the lockstep base 2 up (along with the ladder stairs 18). The caster wheels 4 then support the weight of the ladder 1 (FIG. 9*b*). The latch arm 26 extending from the lockstep frame 20 to the caster frame 8 is forced down (by the downward movement of the lockstep frame 20) as the lockstep arm passes over latch catch 24, thereby compressing the latch spring 28 (FIG. 9*c*). Eventually the latch arm 26 slides over the latch catch 24 and into the locked position (FIG. 9*d*). With the latch 25 closed, the lockstep frame 20 is prevented from pivoting back to the up position. The latch 25 is held in place by the latch spring 28 pressing the latch arm 26 against the latch catch 24. Engaging the caster wheels 4 as described involves lifting the ladder stairs 18 by rotating the ladder stairs 18 and ladder frame 40 about the rear wheels 41. This lifting task is made easier by the rollers 6 and the leverage created by the lockstep frame 20 and foot pedal 3.

In one embodiment, the compression springs 5 are calibrated so that when in the rolling position they support the weight of the ladder plus seventy pounds, but remain essentially decompressed thus allowing the shock link to function.

Figure 4:
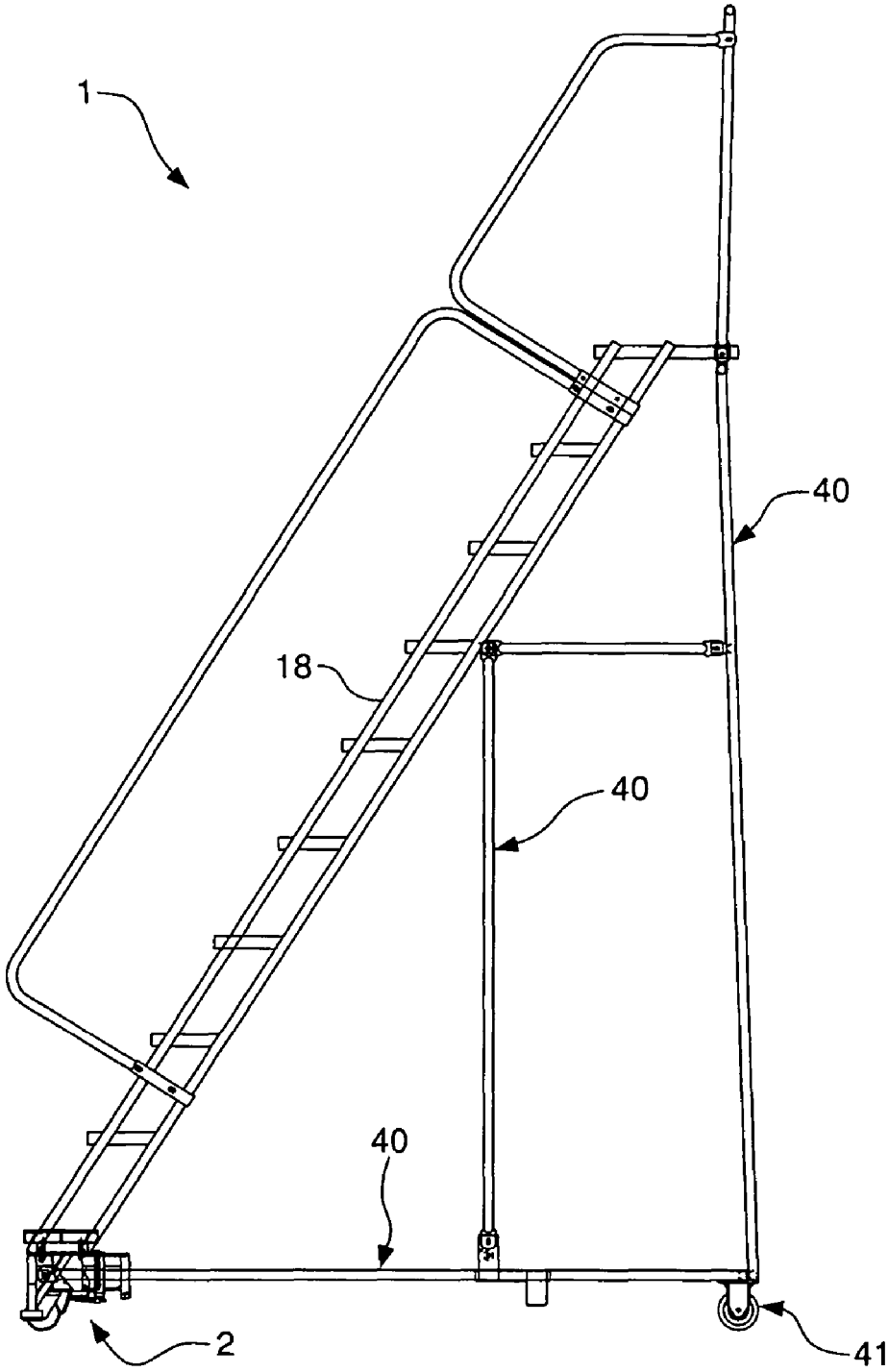
FIG. 4 is a side view of a rolling ladder incorporating the lockstep.

The lockstep 2 is attached, preferably rigidly, to the ladder stairs 18 and the ladder frame 40 as shown in FIG. 4 to form the rolling ladder 1. The rear wheels 41 are connected rotationally to the ladder frame 40.

The terms wheels and casters are used interchangeably herein and the use of either term herein is not meant to exclude the other term and is meant to include any rolling mechanism. Likewise the latch is not meant to be limited to the spring loaded latch described but may be any type of latching mechanism, including mechanical or magnetic.

The particularly embodiment described herein is provided by way of example and is not meant in any way to limit the scope of the claimed invention. It is understood that the invention is not limited to the disclosed embodiments, but on the contrary, is intended to cover various modifications and equivalent arrangements included within the spirit and scope of the appended claims. Without further elaboration, the foregoing will so fully illustrate the invention, that others may by current or future knowledge, readily adapt the same for use under the various conditions of service

What is claimed is:

1. A weight actuated lockstep mechanism for a rolling ladder comprising:

a lockstep base;

a caster frame comprising casters, the caster frame being pivotally attached to the lockstep base;

a shock link pivotally attached to the lockstep base and being held in place by a spring connecting the shock link to the lockstep base;

a lockstep frame pivotally attached to the shock link at a fixed pivot point;

a latch releasably connecting the lockstep frame and the caster frame.

2. The lockstep mechanism of claim 1 wherein the latch is a spring loaded latch.

3. The lockstep mechanism of claim 1 wherein the lockstep base further comprises feet.

4. The lockstep mechanism of claim 1 wherein the lockstep frame further comprises a foot pedal.

5. The lockstep mechanism of claim 1 further comprising a rolling member extending from the lockstep frame, the rolling member being in contact with the caster frame.

6. The lockstep mechanism of claim 1 wherein the spring is adjustable so that the latch releases when a weight of about at least seventy pounds or more is applied to the lockstep base.

7. A rolling ladder comprising:

a set of ladder stairs;

a ladder frame attached to the ladder stairs;

a rear wheel attached to the ladder frame;

a weight actuated lockstep mechanism attached to the ladder frame and ladder stairs, comprising:

a lockstep base;

a caster frame comprising casters, the caster wheel frame being pivotally attached to the lockstep base;

a shock link pivotally attached to the lockstep base and being held in place by a spring connecting the shock link to the lockstep base;

a lockstep frame pivotally attached to the shock link at a fixed pivot point;

a latch releasably connecting the lockstep frame and the caster frame.

8. The rolling ladder of claim 7 wherein the latch is a spring loaded latch.

9. The rolling ladder of claim 7 wherein the lockstep base further comprises feet.

10. The rolling ladder of claim 7 wherein the lockstep frame comprises a foot pedal.

11. The rolling ladder of claim 7 further comprising a rolling member extending from the lockstep frame, and the rolling member being in contact with the caster frame.

12. The rolling ladder of claim 7 wherein the spring is adjustable so that the latch releases when a weight of about at least seventy pounds is applied to the ladder stairs.

13. The lockstep mechanism in accordance with claim 1 wherein the caster frame is pivotally attached at a first point, the shock link is pivotally attached at a second point, and the lockstep frame is pivotally attached at a third point.

14. The rolling ladder in accordance with claim 7 wherein the caster frame is pivotally attached at a first point, the shock link is pivotally attached at a second point, and the lockstep frame is pivotally attached at a third point.

15. The lockstep mechanism in accordance with claim 1 wherein the latch provides a positive lock between the lockstep frame and the caster frame, the latch releases upon an application of sufficient force to the lockstep base.

16. The rolling ladder in accordance with claim 1 wherein the latch provided a positive lock between the lockstep frame and the caster frame, the latch releases upon an application of sufficient force to either the lockstep base or the ladder stairs.

* * * * *